US005575101A

United States Patent [19]

Piccini

[11] Patent Number: 5,575,101

[45] Date of Patent: Nov. 19, 1996

[54] GUN EQUIPPED WITH A MOVEABLE HANDSHIELD FOR CONTROLLING GUN LOADING

[75] Inventor: Carlo Piccini, Forescia, Italy

[73] Assignee: Browning, societe anonyme, Belgium

[21] Appl. No.: 467,285

[22] Filed: Jun. 6, 1995

[30] Foreign Application Priority Data

Jul. 13, 1994 [BE] Belgium ..... 09400657

[51] Int. Cl.[6] ..... F41A 3/00

[52] U.S. Cl. ..... 42/16; 42/71.01; 42/75.01; 42/17

[58] Field of Search ..... 42/16, 17, 14, 42/69.02, 75.01, 71.01

[56] References Cited

U.S. PATENT DOCUMENTS 3,041,768 7/1962 Brooks ..... 42/16
4,502,238 3/1985 Farrar et al. ..... 42/72
5,119,575 6/1992 Gajdica ..... 42/19
5,524,374 6/1996 Gernstein ..... 42/1.06

FOREIGN PATENT DOCUMENTS 85836 7/1895 Germany .

*Primary Examiner*—J. Woodrow Eldred
*Attorney, Agent, or Firm*—Bacon & Thomas

[57] ABSTRACT

A gun equipped with a mobile handshield for controlling gun loading, includes a casing (1), a barrel (2) mounted onto this casing (1) and extending axially, a mobile part (6) extending in the axial direction in relation to the casing (1) for controlling a loading mechanism mounted in the casing. The handshield (5) is fixed to this mobile part (6) and is guided by guiding means (11-12), such that the handshield (5) is fixed in a tilting manner to the mobile part (6). The guiding means (11-12) of the handshield (5) are such that they make the rear end of the handshield (5) tilt downwards when it is moved backwards, such that the outer rearward end of the handshield (5) can move over a distance under the casing (1).

6 Claims, 2 Drawing Sheets

GUN EQUIPPED WITH A MOVEABLE HANDSHIELD FOR CONTROLLING GUN LOADING

BACKGROUND OF THE INVENTION

The invention concerns a gun equipped with a moveable handshield for controlling the loading of the gun. The gun includes a casing (or stock), a barrel mounted on this casing and extending axially, a mobile part moveable in the axial direction in relation to said casing for controlling a loading mechanism mounted in the casing. The handshield is fixed with its front end to this mobile part and is guided with its rear end by guiding means.

Guns of this type, with a pump mechanism, are loaded by the shift of the handshield (or hand grip) to the back and subsequently to the front. Due to the rear shift, the percussion hammer is put in the cocked position by the loading mechanism. If any firing has preceded, the empty case will be simultaneously ejected by this movement. The following cartridge is then supplied by the return movement of the handshield towards the front.

Given the fact that in these known guns, the guiding means guide the handshield linearly in the axial direction, a space must be provided between the casing and the handshield to allow for the backward movement from the front position, since the casing actually restricts this movement. Thus, when the handshield is in its front position, the rear end thereof is not joined to the casing, which results in an unaesthetic appearance and part of the guiding and the rods not being protected.

SUMMARY OF THE INVENTION

The invention aims to remedy these disadvantages and to provide a gun provided with a mobile handshield for controlling the loading of the gun, in which the handshield, when in front position or in rest position, is joined in an aesthetic manner to the casing at its rear end, thus providing maximum protection to the elements of the gun.

This aim is reached in that the handshield is fixed in a tilting manner to said mobile part, whereas the guiding means are such that they make the handshield tilt downwards when it is moved backwards, such that the rear end of the handshield can slide over a distance under the casing in the cocked position.

According to a preferred embodiment of the invention, the mobile part of the gun contains a slide guided by a guide fixed to the casing and extending in an axial direction and at least one control rod which is drawn along by the slide, whereby the handshield covers said slide, at least part of the guide and part of the control rod in the front position.

According to one embodiment of the invention, the guiding means contain at least one groove in the handshield and at least one protrusion mounted upon or in front of the casing and going into the groove, whereby said groove contains a part which is, in the front position of the handshield, inclined in relation to the axial direction.

BRIEF DESCRIPTION OF THE DRAWINGS

For clarity's sake, an example of an embodiment of the invention is described below, as an example only and without being limitative in any way, with reference to the accompanying drawings, in which.

DETAIL DESCRIPTION

Figure 1:
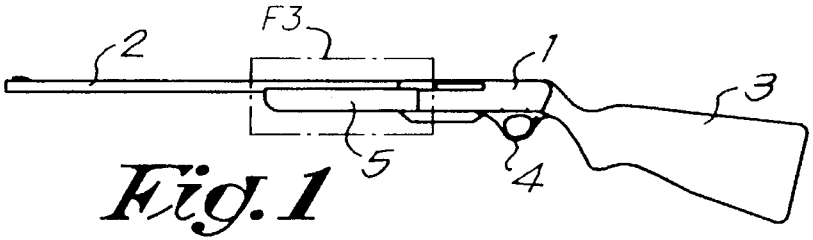
FIG. 1 is a general side view of a gun according to the invention with the handshield in its normal rest position.

The gun according to the invention is of the type with a pump mechanism and contains, as shown in FIG. 1, a casing 1, a barrel 2 mounted axially at the front of this casing 1, a butt 3 prolonging the casing 1 towards the back and containing the trigger guard 4 and a handshield 5 serving to reload the arm and extending, at the front of the casing 1, along the barrel 2.

Figure 4:
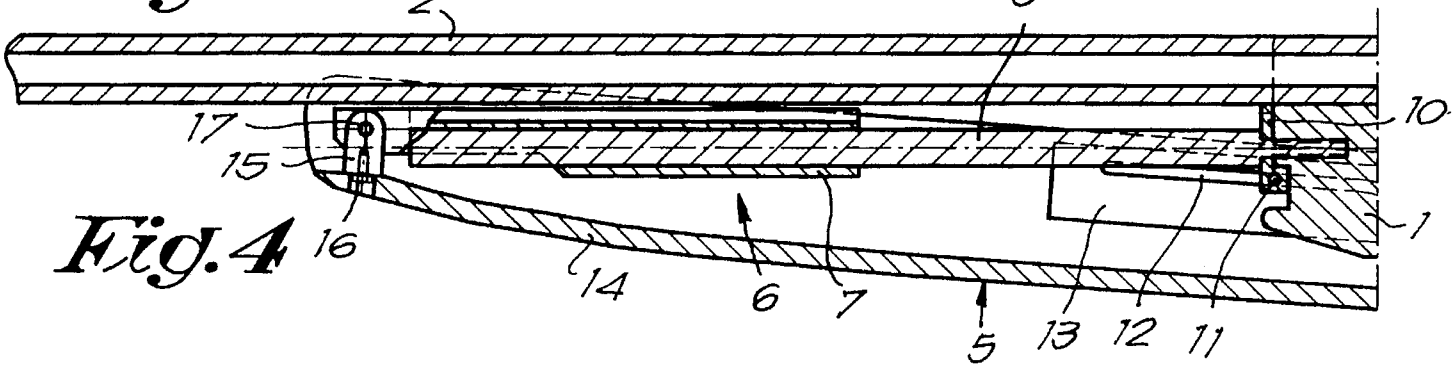
FIG. 4 shows the part indicated by F4 in FIG. 2 as a section and to a larger scale.
Figure 5:
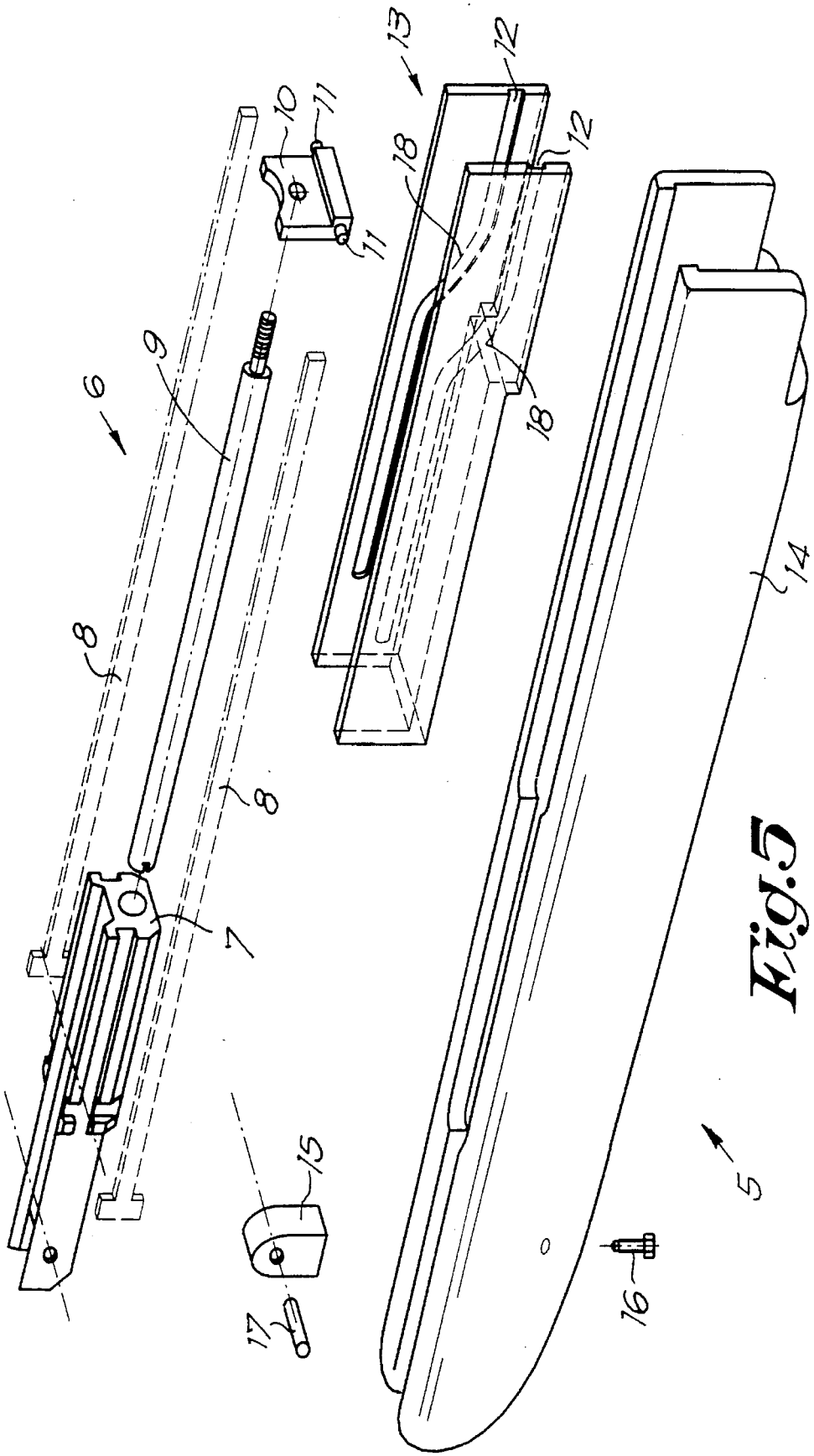
FIG. 5 shows, in exploded view, the main elements of the part shown in FIGS. 3 and 4.

A loading mechanism of a known construction which is not described hereafter is mounted inside the casing 1. This mechanism is controlled by a mobile part 6 of which only the slide 7 and the control rods 8 are represented in the FIGS. 3 to 5.

A control rod 8 is hooked with its foot on either side of the slide 7. This slide 7 slides over a guide 9 in the shape of a cylindrical rod which extends in the axial direction, parallel to the barrel 2. This guide 9 is provided at the back with a threaded end with a limited diameter which is screwed in the front end of the casing 1, simultaneously fixing a support element 10 against the front end of the casing 1.

This support element 10 has the shape of a plate with a broadened lower edge. This edge contains at its ends and thus on either side of the support element 10 a cylindrical protrusion 11.

The two protrusions 11 fit into grooves 12 provided in the inner wall of the two branches of a metal, U-shaped element 13, assembled by means of bonding, for example inside the rear part of the body 14 of the handshield 5 in the shape of a trough slide. These grooves 12 work in conjunction with the protrusions 11 and together form guiding means guiding the handshield 5 during its longitudinal movement.

The grooves 12 end in the rear end of this part 13 and have, at a short distance of this end, an inclined part 18 which goes back to the front and joins a higher groove part extending in the longitudinal direction of the handshield 5.

The handshield 5 also contains a connecting element 15 which is fixed, by means of a screw 16, to the front at the back of the body 14. This connecting element 15 is inserted between the two branches of the fork-shaped front end of the slide 7 and is connected in a tilting manner to these branches by means of a pin 17.

Figure 3:
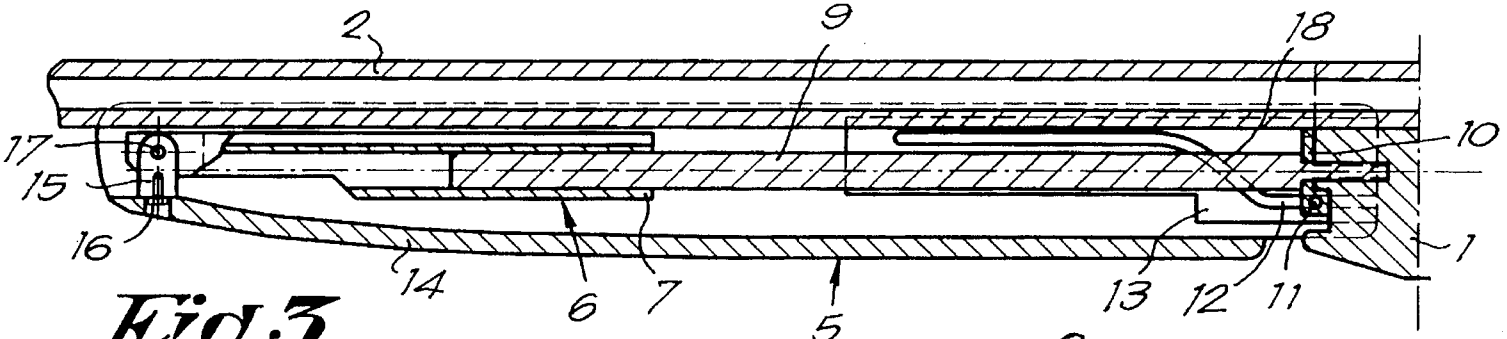
FIG. 3 shows the part indicated by F3 in FIG. 1 as a section and to a larger scale.

The above-described gun works as follows:

In its normal rest position, the handshield 5 is situated along the barrel 2, with its rear end joined to the casing 1, as represented in FIGS. 1 and 3.

In order to load the gun, the handshield 5 is drawn backwards. The handshield 5 carries along the slide 7 which, in turn, by sliding over the guide 9, carries along the control rods 8 which control the bolt and the loading mechanism (not shown). As a result, a case which might possibly be situated inside the firing chamber is ejected, and the firing chamber is reloaded.

Due to the inclined part 18 of the grooves 12 in which are situated the protrusions 11, fixed in relation to the casing 1, the rear end of the handshield 5 is moved away from the barrel 2 at the beginning of said movement, until the protrusions 11 are situated in the front part of the grooves 12.

Figure 2:
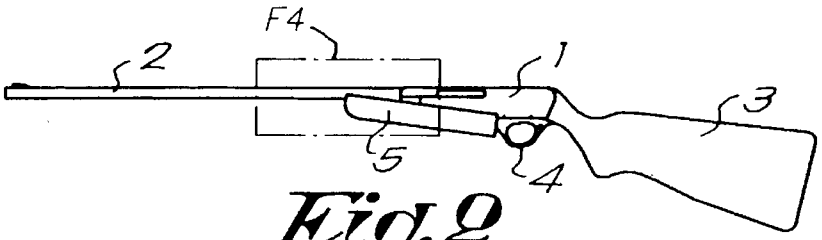
FIG. 2 shows a view similar to that in FIG. 1, but with the handshield in cocked position.

Thus, the handshield 5 tilts downwards around the pin 17 in relation to the slide 7, and its rear end can move under the casing 1 during the backward movement. The handshield 5 is shown in its tilted position or cocked position in FIGS. 2 and 4.

When the handshield 5 is pushed forward again by the shooter, it tilts again into the position in which it extends parallel to the axis of the gun. The rear end at the back of the handshield 5 is then again situated practically against the front end of the casing 1, and the whole part of the mobile part 6 situated in front of the casing 1 is protected by the handshield 5 and is entirely covered, which gives the gun an aesthetically attractive.

It is clear that many modifications can be made to the above-described example while still remaining within the scope of the invention as defined in the following claims.

I claim:

1. A gun comprising a casing including a forward end area; a barrel extending axially from the forward end area of the casing and supported by the casing; a handshield for controlling gun loading movably mounted for rearward and forward movement generally axially along the gun barrel; and relative to said casing, said handshield including forward and rearward end portions, with the rearward end portion terminating adjacent the casing when the handshield is in its forward normal rest position; a mobile part for controlling a gun loading device connected to the handshield for actuation thereby; guiding means for supporting and guiding the handshield such that upon rearward movement of the handshield from its forward rest position, said rearward end portion of said handshield tilts downwardly below the forward end area of the casing, whereby, upon such rearward movement, said rearward end portion of the handshield moves over a distance under the forward end area of said casing.

2. A gun according to claim 1, including an axially extending guide fixed to the casing and projecting forwardly of the casing; a slide associated with said mobile part movable axially along the guide; a gun loading control rod connected to and movable with the slide; said handshield covering said guide, slide and rod when the handshield is in its forward rest position.

3. A gun according to claim 2 wherein said guiding means comprises at least one groove extending in an inclined direction relative to the axial direction of the gun and at least one protrusion slidable in the groove, said grove and protrusion operatively associated with and respectively connected to one of the forward end area of the casing and the rearward end portion of the handshield so as to cooperate with each other when the handshield is moved axially to cause said downward tilting of the rearward end portion of the handshield upon rearward movement of the handshield.

4. The gun according to claim 3, wherein the protrusion is fixedly connected to the casing by a fastener arrangement including said guide.

5. A gun according to claim 3, wherein said at least one groove comprises a pair of transversely spaced parallel extending grooves connected to the handshield for axial movement therewith, and said at least one protrusion comprises a pair of protrusions fitting into said grooves, said protrusions fixedly mounted to the forward end area of said casing.

6. A gun according to claim 5, wherein said handshield is in the form of a trough and including a pivot connection for pivotally connecting the forward end portion of the handshield to said slide.

* * * * *